United States Patent [19]

McCanney

[11] Patent Number: 4,851,649

[45] Date of Patent: Jul. 25, 1989

[54] APPARATUS AND METHODS FOR MANUALLY COUNTING PILLS OR SIMILAR OBJECTS OF CIRCULAR CROSS-SECTION

[76] Inventor: Thomas O. McCanney, 3044 Carters Corner Rd., Sunbury, Ohio 43074

[21] Appl. No.: 215,363

[22] Filed: Jul. 5, 1988

[51] Int. Cl.[4] ..... G06M 11/00

[52] U.S. Cl. ..... 235/98 R; 235/1 R; 235/1 D; 206/534; 206/538; 206/540

[58] Field of Search ..... 235/1 R, 1 D, 98 R, 235/98 A, 98 C; 206/528, 534, 538, 545, 557, 559, 561-567; 209/911, 702; 221/2, 5, 7, 8, 28

[56] References Cited

U.S. PATENT DOCUMENTS 2,923,437 2/1960 Miller ..... 221/7 X
2,952,369 9/1960 Rew ..... 206/557 X
3,290,488 12/1966 Sewell ..... 235/98 C X
4,261,683 4/1981 Zaleon ..... 209/702 X
4,716,280 12/1987 Eberle ..... 235/98 R X

*Primary Examiner*—B. R. Fuller
*Attorney, Agent, or Firm*—Joseph R. Black

[57] ABSTRACT

The invention provides a method and apparatus for manually counting pills or similar objects. Pills in excess of a required number are deposited in a counting area which has the general shape of an equilateral triangle and is defined by walls which surround all but a small open peripheral range of the area. The excess pills are separated from the required number on the counting area, and the user tilts the apparatus to cause the excess to slide out of the area through the open peripheral range while retaining the required number in the counting area. The user then tilts the apparatus to cause the required number of pills to slide out of the area through the open peripheral range.

14 Claims, 4 Drawing Sheets

APPARATUS AND METHODS FOR MANUALLY COUNTING PILLS OR SIMILAR OBJECTS OF CIRCULAR CROSS-SECTION

BACKGROUND OF THE INVENTION

1. Technical Field

The present invention relates to methods for manually counting pills or similarly shaped objects and to apparatus adapted for use with said methods.

2. Related Art

In medical and related fields, for example, it is a commonplace task to remove pills from a container in order to fill a prescription. Typically, this is done by removing from the container a number of pills that clearly exceeds the need, counting and separating from this number the number actually needed, returning the excess to the container, and depositing the prescribed number of pills in a container suitable for dispensation to the patient or agent thereof. This tedious task is performed several times each day by thousands of people whose time would be better spent exercising the special skills and knowledge they have acquired. For example, it is not unusual for a doctor of veterinary medicine to spend several hours per week on this task. A more familiar and extreme example is the pharmacist. Although modern technology presents a number of possible methods for performing this task by automatic means, complications including cost and non-uniformity of pill size and shape have apparently precluded the commercialization of these methods, so that the task is still performed manually.

Perhaps the most familiar apparatus for performing the task is that illustrated in FIG. 1 of the accompanying drawings and designated generally by the numeral 2. Another known apparatus is that illustrated in FIG. 2 and designated generally by the numeral 4. In using the apparatus 2, a supply of pills (contained in a bottle or other pill reservoir provided by the manufacturer) is poured onto a counting surface 6. Most of the counting surface 6 is surrounded by stop means including walls 8, lips 9, or inclines 10 to assist in preventing the pills from sliding off the counting surface. Using a knife or similar device, the user counts from the supply of pills poured onto the counting surface 6 and separates from the excess the number of pills required by the prescription. The prescribed number of pills are then pushed into a dispensing chute 12, leaving the excess on the counting surface 6. A hinged, door-like component 14 is then closed to form a funnelled chamber from which pills can only escape through a funnel opening 16. The user then tilts the device 2 in a direction such that the pills remaining on the counting surface 6 depart therefrom via an opening 18 in the stop means, while the pills in the dispensing chute slide along the chute and away from the funnel opening 16, positioning the device and the pill reservoir with respect to each other so that the excess is returned to the reservoir via the opening 18. The user than tilts the device 2 in a direction such that the pills remaining in the dispensing chute 12 slide along the chute and through the funnel opening 16 while positioning the device with respect to a bottle or other receptacle so that the pills are delivered into the receptacle.

From the standpoint of time consumption, the predominant element of the above-described procedure is the act of counting the number of pills required by the prescription. However, the apparatus 2 is also inefficient in comparison with the apparatus and methods of the present invention in that it requires extraneous operations such as opening and closing the door-like component 14.

The pill counting apparatus 4 of FIG. 2 has an advantage over the apparatus 2 of FIG. 1 in that it requires considerably less time to count larger numbers of pills. The apparatus 4 takes advantage of the fact that the most compact arrangement for packing objects of circular cross-section is a hexagonal close-packed configuration in which a centrally located pill 20 is surrounded by and in contact with six other pills 22 (FIG. 4). By pouring pills onto the counting surface 6 and jiggling the apparatus 4 with the vertex 32 in a relatively low position, the pills will automatically arrange themselves in a hexagonal close-packed structure confined by a sixty-degree, V-shaped stop 34 which defines two sides of the counting surface. The user can then simply count the number of rows which yields a corresponding number of pills close to the required number, separate and remove any excess, and be left with the number of pills required by the prescription. A table 36 is typically provided to facilitate counting.

Although the apparatus 4 is more efficient than that of FIG. 1 when counting larger numbers of pills, it is relatively cumbersome once the act of counting is completed and the acts of dispensing the excess pills to the supply resorvoir and the prescribed number of pills to a suitable container begin. Without using some external means, the process of dispensing either the prescribed number of pills or the excess into a container while keeping the remaining pills on the counting surface 6, and then dispensing the remaining pills into another container, is necessarily inefficient in comparison with the methods and apparatus provided by the instant invention.

An objective of the present invention is to substantially reduce the time spent in counting and/or dispensing pills or similarly-shaped objects.

Another objective of the invention is to provide apparatus for manually counting pills or similarly-shaped objects, whereby the apparatus is both easy to use and capable of being manufactured in large quantities at low cost.

Other objectives and advantages provided by the invention will be apparent from the following description, the appended claims, and the accompanying drawings.

SUMMARY OF THE INVENTION

The present invention provides methods for manually counting and dispensing pills or other objects of circular cross-section, and apparatus for use therewith.

The methods of the present invention comprise the steps of depositing a number, "n+x" of objects onto a surface having a counting area that has at least two boundaries separated at a nominal angle of sixty degrees; positioning the objects on the surface so that the objects are in a hexagonal close-packed configuration; separating an excess number "x" of the objects from the configuration; first, tilting the surface to cause the excess number of objects to slide along and depart from the surface while simultaneously preventing departure of the number "n" of objects from the surface; and a second, tilting the surface to cause the number "n" of objects to slide along and depart from the surface.

The apparatus of the present invention comprise a member having an upper surface including a counting area onto which the objects are positioned for counting; and stop means secured to or integral with the member, the stop means including first, second, and third portions which collectively surround the counting area at its periphery except over an open peripheral range thereof so that in sliding along the surface corresponding to the counting area the objects can depart therefrom only through the open peripheral range, wherein the first and second portions of the stop means converge toward a vertex of the counting area at a nominal angle of sixty degrees so that at least a portion of the counting area has the shape of an equilateral triangle, and wherein the open peripheral range is defined by a distance between the third portion of the stop means and either of the first and second portions of the stop means.

The upper surface of the apparatus may further comprise a dispensing area onto which the objects are positioned for dispensing, the dispensing area being separated from the counting area along the third portion of the stop means and being positioned with respect to the open peripheral range of the counting area so that objects sliding along the upper surface and departing from the counting area enter the dispensing area.

The stop means may also include a fourth portion which assists in confining to the dispensing area the objects that have entered thereon so that in sliding away from the open peripheral range the objects can depart from the dispensing area only through a different opn peripheral range thereof.

DESCRIPTION OF THE PREFERRED EMBODIMENT

Figure 1:
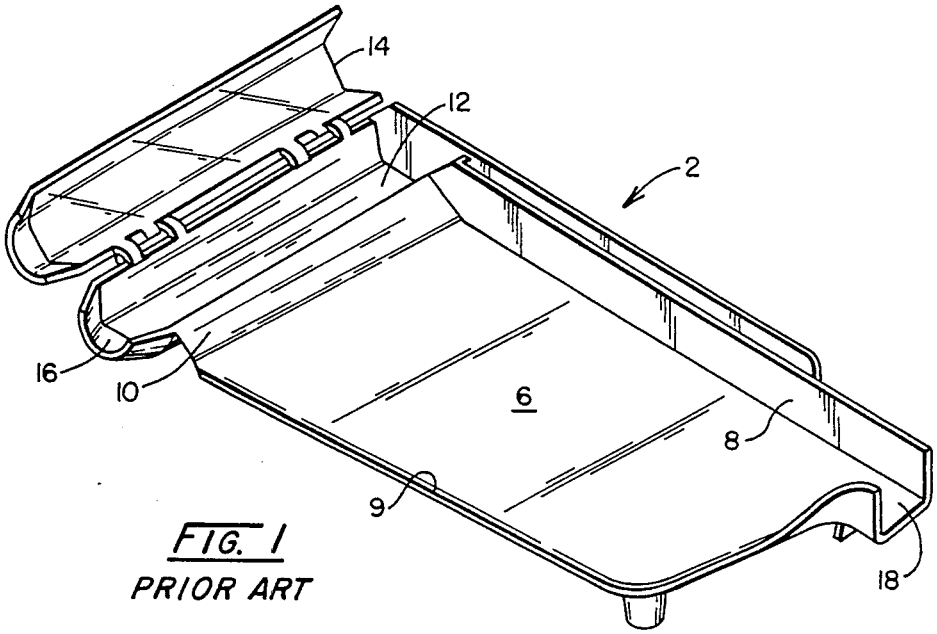
FIG. 1 PRIOR ART
FIGS. 1 and 2 are perspective drawings of manual pill-counting apparatus known in the prior art.
Figure 2:
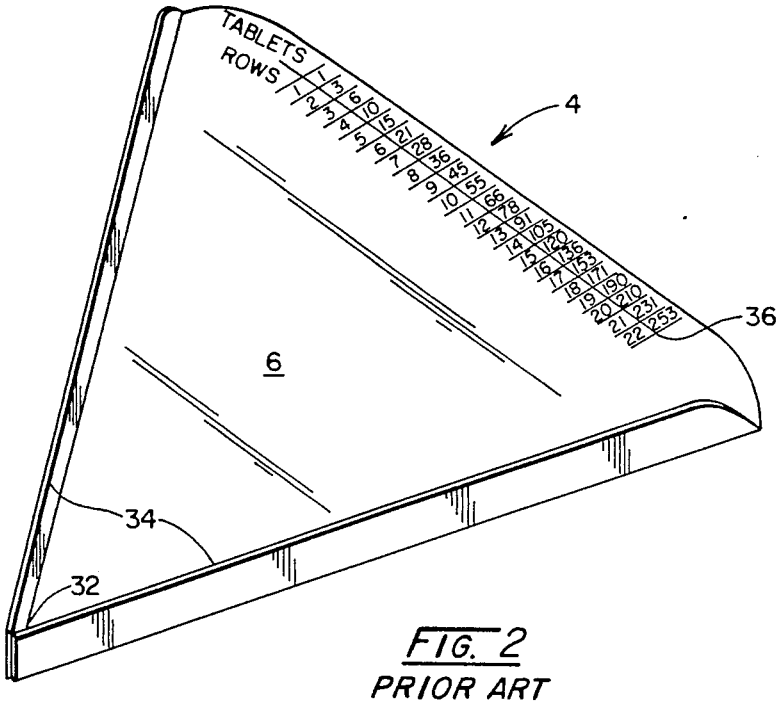
FIG. 2 PRIOR ART
Figure 3:
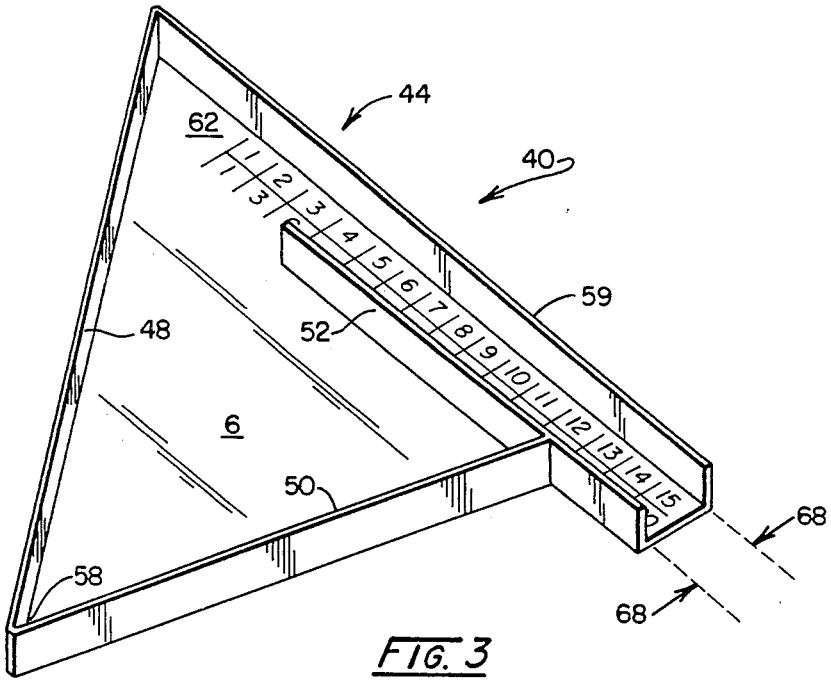
FIG. 3 is a perspective drawing of the preferred embodiment of the invention.

Referring to FIG. 3, the numeral 40 designates a pill counting apparatus that may be manufactured by an integral formation process such as injection molding, or by any of a variety of well-established methods for joining discrete components.

The apparatus 40 has a generally flat upper surface 44. The term "upper surface" is herein intended to mean all surface portions of the apparatus 40 which generally face the user except those portions corresponding to stops as hereinafter described, even though all portions of the upper surface may not be in a common plane for some embodiments.

Figure 4:
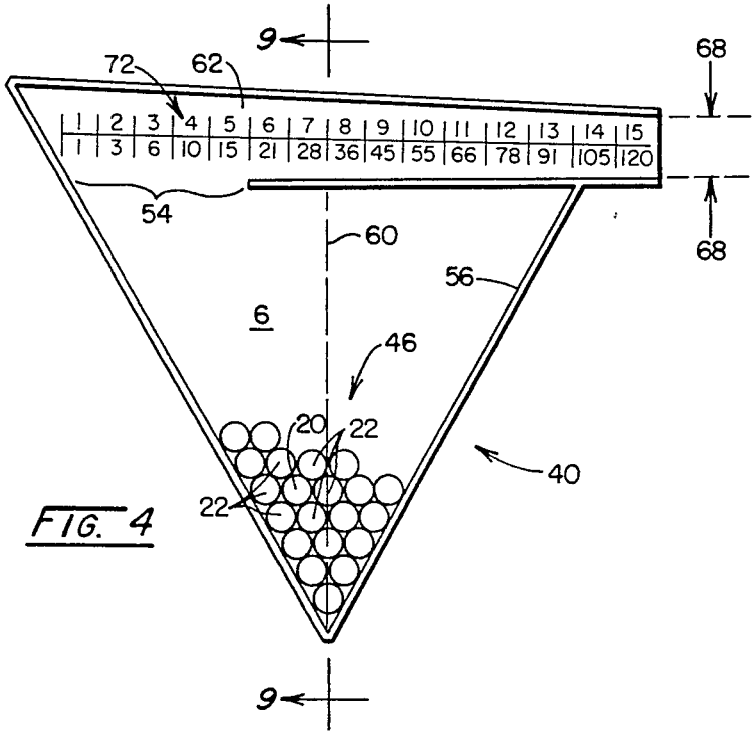
FIG. 4 is a top elevational view of the preferred embodiment illustrating a hexagonal close-packed configuration for the objects to be counted.
Figure 5:
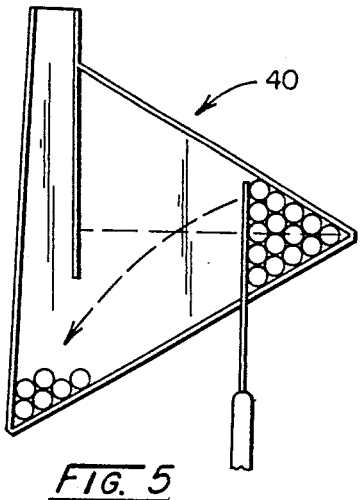
FIGS. 5–8 are top elevational views illustrating various modes of use and various steps in the method according to the preferred embodiment.
Figure 6:
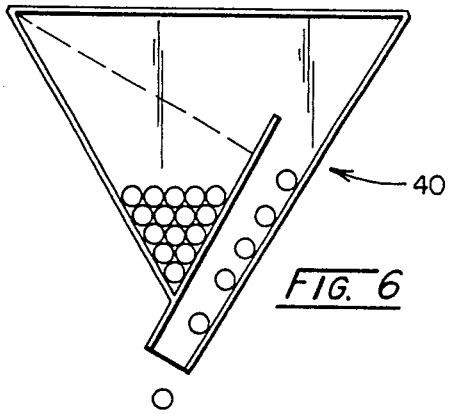

At least a portion of the upper surface 44 is a counting area 6 into which pills 46 (FIG. 4) are deposited for counting. Stop means for confining pills to the upper surface 44 are secured to or integral with the apparatus 40 and include first, second, and third portions 48, 50, and 52, respectively, which define at least three sides of the counting area 6 and collectively surround the counting area at its periphery except over an open peripheral range 54 thereof. Thus, in sliding along the surface corresponding to the counting area 6, the pills can depart therefrom only through the open peripheral range 54. The inside walls (as at 56) of the first, second, and third portions 48,50,52 are preferably vertical and continuous along the counting area 6 so that when using the apparatus 40 as described hereinafter, the pills 46 are free to slide along the inside wall, and the upper surface 44 can be tilted over a considerable range of angles without causing the pills to fall off the surface.

The first and second portions 48,50 of the stop means converge at a nominal range of sixty degrees toward a vertex 58 of the counting area 6. The open peripheral range 54 is defined by a distance of separation between the first portion 48 and the third portion 52, or between the third portion and the second portion 50, depending on whether the apparatus 40 is designed for a left-handed or a right-handed user.

Figure 10:
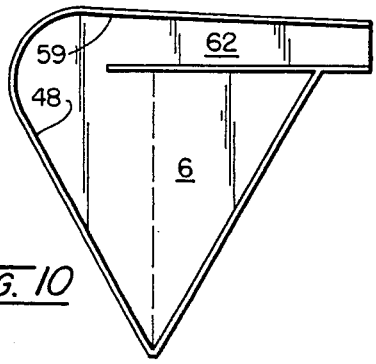
FIGS. 10, 11, and 13 are top elevational views illustrating further embodiments of the invention.

The third portion 52 is preferably linear and perpendicular to the indicated geometrical bisector 60 of the counting area 6. Therefore, although some portion of the counting area 6 will have the shape of an equilateral triangle in any embodiment due to the nominal angle of convergence required to achieve a hexagonal close-packed configuration for the pills, the counting area 6 of the preferred embodiment can be considered an equilateral triangle. However, it is stressed that deviations from this shape that retain the functional advantages of the third portion 52 of the stop means as taught herein are considered within the scope of the invention. For example, providing curvature between the second and third portions 50,52 of the stop and/or between the first portion 48 and a fourth portion 59, the latter of which is exemplified by the embodiment of FIG. 10, is considered within the scope of the invention. Deviations from perpendicularity between the third portion 52 and the bisector 60 to a degree which is slight enough to retain the functional advantages provided by the third portion are likewise considered within the scope, as are differences in the shape of the third portion which also retain these functional advantages. Moreover, substituting a gate or similar device for the third portion 52, which device provides the stopping function of the third portion at the appropriate step in the method for using the apparatus 40 as hereinafter described is considered within the scope.

Figure 9:
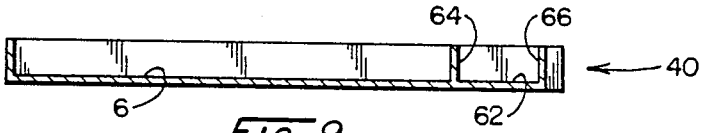
FIG. 9 is a cross-sectional view taken along line 9—9 of FIG. 4.

A second portion of the upper surface 44 is a dispensing area 62. The dispensing area 62 has channel walls 64,66 (FIG. 9) formed by the indicated walls of the third and fourth portions 52,59 of the stop 48. The channel walls 64,66 assist in confining to the dispensing area 62 the pills that have entered thereon so that in sliding away from the open peripheral range 54, the pills can depart from the dispensing area only through a different open peripheral range 68 of the dispensing area. The dispensing area 62 is separated from the counting area 6 along the third portion 52 of the stop means and is positioned with respect to the open peripheral range 54 so that pills sliding along the counting area and departing therefrom enter the dispensing area.

Figure 11:
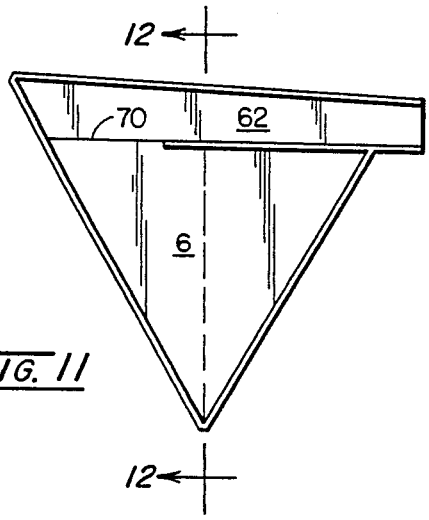
Figure 12:
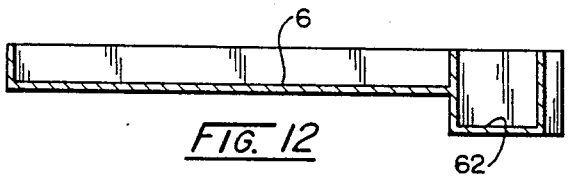
FIGS. 12 and 14 are cross-sectional views of the embodiments of FIGS. 11 and 13, respectively.
Figure 13:
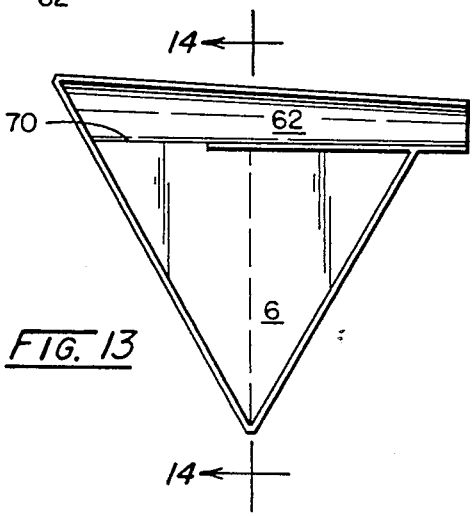
Figure 14:
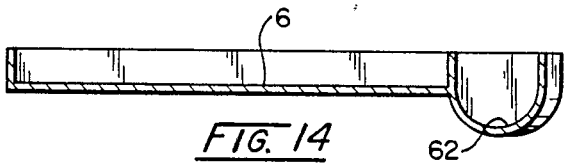

In the preferred embodiment, the counting area 6 and the dispensing area 62 are coplanar and form a continuous surface so that they join at the open peripheral range 54. However, in other contemplated embodiments including those illustrated in FIGS. 11 and 13, the counting area 6 and the dispensing area 62 are noncoplanar so that a drop-off 70 (FIGS. 12 and 14) is formed.

To facilitate counting, a table 72 (FIG. 4) is provided on the dispensing area 62 by any suitable means. The relation between the number of rows and the corresponding number of pills is:

$$\#\text{Pills}=[\#Rows(\#\text{Rows}+1)]/2.$$

The prototype of the apparatus 40 was made of a triangular wooden base to which the first, second, third, and fourth portions of the stop means were secured as discrete components by an adhesive. However, it is contemplated that the most cost-effective means of manufacture will be a molding process in which the entire apparatus 40 is made of plastic and formed as an integral unit. The preferred method of using the apparatus will now be described with reference to FIGS. 5–8.

A number, "n+x", of pills from which the user desires a number, "n", are deposited onto the upper surface 44 in the counting area 6. The user then positions the pills on the upper surface 44, preferably in the counting area 6, such that the pills are in a hexagonal close-packed configuration (as by tilting the apparatus 40 so that the vertex 58 is in a relatively low position and jiggling the apparatus if necessary). Knowing the number of rows which provides the closest approximation to "n" (as by glancing at the table 72), the user counts the appropriate number of rows. The user then separates the excess pills "x" from the desired number "n" as exemplified in FIG. 5 by using any suitable means such as a card, knife, hand, or functionally similar object and slides the excess through, or sufficiently close to, the open peripheral range 54. The user then tilts the apparatus 40 (and thus the upper surface 44) in directions such that the excess number "x" of pills are caused to slide along the surface corresponding to the dispensing area 66 and to depart from the upper surface 44 by falling off the dispensing area through the different open peripheral range 68 thereof, while the desired pills "n" are simultaneously prevented from departing the upper surface, as exemplified in FIG. 6. The user then tilts the apparatus 40 (and thus the upper surface 44) in directions such that the desired number "n" of pills are caused to slide along the surface corresponding to the counting area 6 onto the surface corresponding to the dispensing area 62 and to depart from the upper surface 44 by falling off the dispensing area through the different open peripheral range 68 thereof, as exemplified in FIGS. 7 and 8. Typically, the user would position the apparatus 40 with respect to a container 74 so that the pills fall directly therein.

Figure 7:
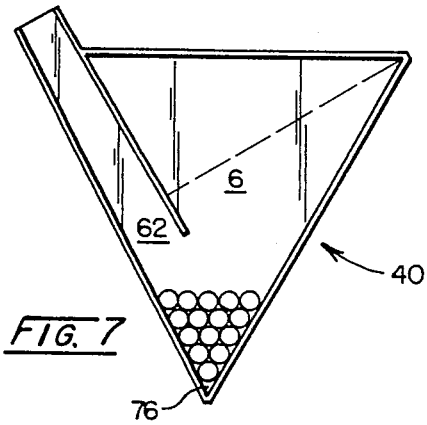
Figure 8:
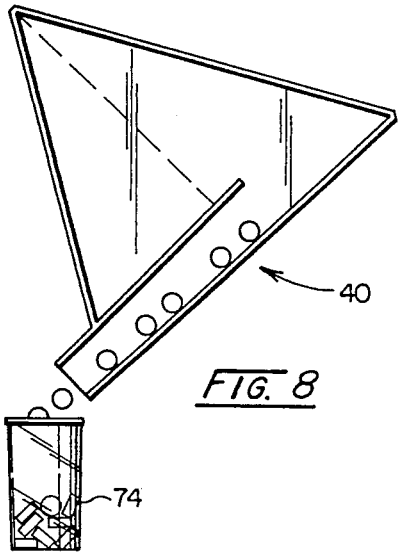

In some cases (depending on the number and size of the pills in relation to the distance defining the open peripheral range 54) the method may be practiced by depositing the pills on the upper surface 44 near the vertex 76 formed by the convergence of the first and fourth portions 48,59 of the stop means so that the hexpack configuration is formed as illustrated in FIG. 7. The excess number "x" of pills would then be separated from the desired number "n" by sliding either the excess or the desired number into the counting area 6. The method would then be completed by performing the tilting operations required to first cause one group of pills to depart from the upper surface 44 via the open peripheral range 68 of the dispensing area 62 while retaining the other group in the counting area 6, and next cause the other group to slide into and along the dispensing area and depart from the surface via the same open peripheral range 68.

Having described the preferred embodiment, it is to be understood that the description is intended as illustrative only, and that nothing delineated or illustrated herein is intended to restrict the scope of the invention to a greater degree than is indicated by the following claims and their equivalents.

What is claimed is:

1. Apparatus for manually counting pills or other small objects having a circular cross-section, comprising:

a member having an upper surface including a counting area onto which the objects are positioned for counting;

stop means secured to or integral with the member for confining the objects to the upper surface, the stop means including first, second, and third portions which collectively surround the counting area at a periphery thereof except over an open peripheral range thereof so that in sliding along the surface corresponding to the counting area, the objects can depart from the counting area only through the open peripheral range, the first and second portions of the stop means converging toward a vertex of the counting area at an angle of about sixty degrees so that at least a portion of the counting area has a shape of an equilateral triangle, and the open peripheral range being defined by a distance between the third portion and either one of the first and second portions.

2. Apparatus as in claim 1 wherein the upper surface of the member further comprises a dispensing area onto which the objects are positioned for dispensing, the dispensing area being separated from the counting area along the third portion of the stop means and being positioned with respect to the open peripheral range of the counting area so that objects sliding along the upper surface and departing from the counting area enter the dispensing area.

3. Apparatus as in claim 2 wherein the stop means also includes a fourth portion which assists in confining to the dispensing area the objects that have entered theron so that in sliding away from the open peripheral range the objects can depart from the dispensing area only through a different open peripheral range of the dispensing area.

4. Apparatus as in claim 3 wherein the counting area and the dispensing area form a continuous portion of the upper surface.

5. Apparatus as in claim 3 wherein the counting area and the dispensing area are planar and the two areas are coplanar.

6. Apparatus as in claim 3 wherein the counting area and the dispensing area are non-coplanar, the surface corresponding to the counting area being generally higher than the surface corresponding to the dispensing area so that a drop-off is formed.

7. Apparatus as in claim 3 wherein the counting area meets the dispensing area at the open peripheral range of the counting area.

8. Apparatus as in claim 4 wherein the third portion of the stop means also assists in confining to the dispensing area the objects that have entered thereon.

9. Apparatus as in claim 3 wherein the third portion of the stop means is linear and substantially perpendicular to a geometrical bisector of the counting area which passes through said vertex.

10. A method for manually counting a number "n" of pills or other objects having a circular cross-section, comprising the steps of:

depositing a number "n+x" of the objects onto a surface which has at least two boundaries separated at an angle of about sixty degrees;

positioning the objects on the surface so that the objects are in a hexagonal close-packed configuration;

separating an excess number "x" of the objects from the configuration;

first, tilting the surface to cause the excess number of objects to slide along and depart from the surface and to simultaneously cause the number "n" of objects to remain on the surface; and second, tilting the surface to cause the number "n" of objects to slide along and depart from the surface.

11. A method as recited in claim 10 comprising the step, performed after the separating step but before causing the excess number objects to depart from the surface, of positioning at least some of the excess number of objects in a dispensing area of the surface which is at least in part separated from a counting area of the surface, the number "n" of objects remaining in the counting area.

12. A method as recited in claim 11 comprising the step, performed after the first tilting step but before causing the number "n" of objects to depart from the surface, of causing the number "n" of objects to enter the dispensing area.

13. A method as recited in claim 12 wherein both the number "n" of objects and the excess number of objects depart from the surface by falling off the dispensing area.

14. A method as recited in claim 13 wherein both the number "n" of objects and the excess number of objects fall off a common peripheral range of the surface.

* * * * *